US005308733A

United States Patent [19]

Rimai et al.

[11] Patent Number: 5,308,733

[45] Date of Patent: May 3, 1994

[54] METHOD OF NON-ELECTROSTATICALLY TRANSFERRING SMALL ELECTROSTATOGRAPHIC TONER PARTICLES FROM AN ELEMENT TO A RECEIVER

[75] Inventors: Donald S. Rimai, Webster; Louis J. Sorriero, Rochester; John M. McCabe, Pittsford, all of N.Y.

[73] Assignee: Eastman Kodak Company, Rochester, N.Y.

[21] Appl. No.: 999,021

[22] Filed: Dec. 31, 1992

[51] Int. Cl.[5] ..... G03G 13/16

[52] U.S. Cl. ..... 430/126; 430/47

[58] Field of Search ..... 430/47, 126

[56] References Cited

U.S. PATENT DOCUMENTS

| | | | |
|---|---|---|---|
| 4,264,667 | 4/1981 | Murakami et al. | 428/195 |
| 4,284,699 | 8/1981 | Berwick et al. | 430/96 |
| 4,377,682 | 3/1983 | Ohguchi et al. | 528/301 |
| 4,576,997 | 3/1986 | Trotter et al. | 525/444 |
| 4,687,360 | 8/1987 | Wellman et al. | 400/241.1 |
| 4,866,158 | 9/1989 | Kubo et al. | 528/272 |
| 4,927,727 | 5/1990 | Rimai et al. | 430/99 |
| 4,952,477 | 8/1990 | Fuller et al. | 430/109 |
| 4,990,424 | 2/1991 | VanDusen et al. | 430/106.6 |
| 5,045,424 | 9/1991 | Rimai et al. | 430/126 |
| 5,055,371 | 10/1991 | Lee et al. | 430/126 |
| 5,061,590 | 10/1991 | Johnson et al. | 430/126 |
| 5,102,767 | 4/1992 | Chowdry et al. | 430/126 |
| 5,102,768 | 4/1992 | Light et al. | 430/126 |
| 5,104,765 | 4/1992 | Chowdry et al. | 430/126 |
| 5,110,702 | 5/1992 | Ng et al. | 430/99 |

OTHER PUBLICATIONS

Research Disclosure dated Dec. 1975, p. 45.

*Primary Examiner*—Roland Martin

*Attorney, Agent, or Firm*—Anne B. Kiernan

[57] ABSTRACT

A method is provided for non-electrostatically transferring dry toner particles which comprise a toner binder and have a particle size of 8 micrometers or less from the surface of an element to a receiver. The receiver comprises a substrate having a coating of a semi-crystalline polyester on a surface of the substrate. The semi-crystalline polyester has a glass transition temperature in a range of from approximately 5° C. to 80° C.; a melting temperature in a range of from approximately 40° C. to 200° C.; a weight average molecular weight in a range of from approximately 10,000 to 150,000; a number average molecular weight in a range of from approximately 5,000 to 75,000; a crystallinity of from approximately 5 to 25 percent by weight, based on the total weight of the polyester and a surface energy of from approximately 44 to 52 dynes/cm. The method involves preheating the receiver to a temperature ranging from approximately 70° C. to 95° C. and contacting the toner-bearing element with the receiver to effectuate the transfer of virtually 100% of the toner particles from the element to the receiver and thereafter separating the receiver from the element while the temperature of the semi-crystalline polyester coating on the receiver is maintained above the glass transition temperature of the semi-crystalline polyester.

The method is particularly well suited for providing images having high resolution and low granularity from very small toner particles.

20 Claims, No Drawings

METHOD OF NON-ELECTROSTATICALLY TRANSFERRING SMALL ELECTROSTATOGRAPHIC TONER PARTICLES FROM AN ELEMENT TO A RECEIVER

FIELD OF THE INVENTION

This invention relates to an improved method of non-electrostatically transferring dry toner particles having a particle size of 8 micrometers or less from an element to a receiver. More particularly, the present invention relates to such a method where the toner particles are contacted with a heated receiver which comprises a substrate which has been coated with a semi-crystalline polyester whereby virtually all of the toner particles are transferred from the element to the receiver.

BACKGROUND

In an electrostatographic copy machine, an electrostatic latent image is formed on an element. That image is developed by the application of oppositely charged dry toner particles to the element. The image-forming toner on the element is then transferred to a receiver where it is permanently fixed, typically, by heat fusion. The transfer of the toner to the receiver is usually accomplished electrostatically by means of an electrostatic bias between the receiver and the element.

In order to produce copies of very high resolution and low granularity, it is necessary to use toner particles that have a very small particle size, i.e., approximately 8 micrometers or less. (Particle size herein refers to mean volume weighted diameter as measured by conventional diameter measuring devices such as a Coulter Multisizer, sold by Coulter, Inc. Mean volume weighted diameter is the sum of the mass of each particle times the diameter of a spherical particle of equal mass and density, divided by total particle mass.) However, it has been found that it is very difficult to electrostatically transfer such fine toner particles from the element to the receiver, especially when they are less than 8 micrometers in diameter. That is, fine toner particles frequently do not transfer from the element with reasonable efficiency. Moreover, those particles which do transfer frequently fail to transfer to a position on the receiver that is directly opposite their position on the element, but rather, under the influence of coulombic forces, tend to scatter, thus lowering the resolution of the transferred image and increasing the grain and mottle. Thus, high resolution images of low granularity require very small particles. However, images having high resolution and low granularity have not been attainable using electrostatically assisted transfer.

In order to avoid this problem, it has become necessary to transfer the toner from the element to the receiver by non-electrostatic processes. One such process is the thermally assisted transfer process where the receiver, typically comprised of printing paper, clay-coated graphic arts printing paper or uncoated copy paper, is heated, typically to about 60° C. to about 90° C., and is pressed against the toner particles on the element. The heated receiver sinters the toner particles causing them to stick to each other and to the receiver thereby effecting the transfer of the toner from the element to the receiver. The element and receiver are then separated and the toner image is fixed, e.g., thermally fused to the receiver. This method is described in detail in U.S. Pat. No. 4,927,727 to Rimai et al.

While the thermally assisted transfer process does transfer very small particles without the scattering that occurs with electrostatic transfer processes, it is sometimes difficult to transfer all of the toner particles by this process. The toner particles that are directly on the element often experience a greater attractive force to the element than they do to the receiver and to other toner particles that are stacked above them, and the heat from the receiver may have diminished to such an extent by the time it reaches the toner particles next to the element that it does not sinter them. As a result, the toner particles that are in contact with the element may not transfer. Attempts to solve this problem by coating the element with a release agent have not proven to be successful because the process tends to wipe the release agent off the element into the developer which degrades both the developer and the development process. Moreover, because the process tends to wipe the release agent off the element, the application of additional release agent to the element is periodically required in order to prevent the toner particles from adhering to the element during transfer.

An alternative approach utilized in the past for removing all of the toner particles from the element was to use as a receiver, a substrate such as printing paper, that had been coated with a thermoplastic polymer. During transfer, the toner particles adhered to or became partially or slightly embedded in the thermoplastic polymer coating and were thereby removed from the element. However, it was found that many thermoplastics that were capable of removing all of the toner particles also tended to adhere to the element. This, of course, not only seriously impaired image quality but it also had the potential of damaging both the element and the receiver. Moreover, it was not possible to predict with any degree of certainty which thermoplastic polymers would remove all of the toner particles from the element without sticking to the element during transfer and subsequent separation of the receiver from the element and which ones would not.

Efforts to overcome these problems first focused on applying a layer of a release agent to the surface of the thermoplastic polymer coating on the receiver substrate and heating the receiver above the Tg of the thermoplastic polymer during transfer as described in U.S. Pat. No. 4,968,578 to Light et al. The release agent prevented the thermoplastic polymer coating from adhering to the element, but it would not prevent the toner from transferring to the thermoplastic polymer coating on the receiver and virtually all of the toner was transferred to the receiver. This constituted a significant advancement in the art because it was now possible not only to obtain the high image quality that was not previously attainable when very small toner particles were transferred electrostatically but, in addition, the problem of incomplete transfer was avoided. In addition, several other advantages were provided by this process. One such advantage was that copies made by this process could be given a more uniform gloss because all of the receiver was coated with a thermoplastic polymer which could be made glossy in contrast to receivers that were not coated with a thermoplastic polymer where only those portions of the receiver that were covered with toner could be made glossy and the level of gloss varied with the amount of toner. Another advantage of this process was that when the toner was fixed, it was driven more or less intact into the thermoplastic polymer coating rather than being flattened and spread out over the receiver. This also resulted in a higher resolution image and less grain. Finally, in images made using this process, light tended to reflect from behind the embedded toner particles that were in the thermoplastic layer which caused the light to diffuse more making the image appear less grainy.

For all of the benefits and advantages provided by this process, however, the application of a release agent to the thermoplastic polymer coating on the receiver in order to prevent the thermoplastic polymer coating from adhering to the surface of the element during transfer and subsequent separation of the receiver from the element created several problems. One such problem was that the release agent tended to transfer to and build up on the element or photoconductor thereby degrading image quality and causing potential damage to both the element and the receiver. Another problem was that the release agent tended to allow the thermoplastic polymer coating to separate from the support or substrate, especially during or after finishing, due to a reduction in the adhesion strength of the thermoplastic polymer coating to the receiver support caused by the tendency of the release agent, which had a lower surface energy than the thermoplastic polymer coating and hence a lesser predilection to adhere to the receiver support than the thermoplastic polymer coating, to migrate through the thermoplastic polymer coating to the interfacial region between the thermoplastic polymer coating and the support and to cause the thermoplastic polymer coating to separate from the support. It was also found that the release agent reduced the gloss of the finished image. Finally, the addition of a release agent to the thermoplastic polymer coating added to the overall cost of the process.

Recently, a technique was described in U.S. Pat. No. 5,043,242 to Light et al for obviating the foregoing limitations whereby fine toner particles having a particle size of 8 micrometers or less could be transferred from the surface of an element to a thermoplastic coated receiver with virtually 100% toner transfer efficiency using the thermally assisted method of transfer without having to apply a coating or a layer of a release agent to the toner contacting surface of the thermoplastic polymer coating on the receiver substrate prior to toner transfer in order to prevent the thermoplastic polymer coating from sticking or adhering to the element surface during transfer of the toner particles from the element to the thermoplastic polymer coated receiver and during the subsequent separation of the receiver from the element. Studies revealed that by carefully selecting, as the thermoplastic polymer coated receiver, a receiver in which the thermoplastic polymer coating material was a thermoplastic addition polymer which had a glass transition temperature that was less than approximately 10° C. above the glass transition temperature of the toner binder and a surface energy within a range of from approximately 38 to 43 dynes/cm and, as the element on which the toner particles which were to be transferred to the receiver were carried, an element, which had a surface layer which comprised a film-forming, electrically insulating polyester or polycarbonate thermoplastic polymeric binder resin matrix and a surface energy not exceeding approximately 47 dynes/cm, preferably 40 to 45 dynes/cm, and further, that by heating the receiver to a temperature such that the temperature of the thermoplastic polymer coating on the receiver substrate during transfer was at least approximately 15° C. above the Tg of the thermoplastic polymer, that it was possible to transfer such very small, fine toner particles non-electrostatically from the surface of the element to the thermoplastic coated receiver and to obtain high resolution transferred images which were not previously attainable using the electrostatic method of transfer while at the same time avoiding the problems of incomplete transfer and adherence of the thermoplastic polymer coating to the element during toner transfer in the absence of a layer of a release agent on the thermoplastic polymer coating, i.e., without having to apply a coating or layer of a release agent to the toner contacting surface of the thermoplastic polymer coating on the receiver substrate prior to contacting the thermoplastic polymer coating with the toner particles on the element surface and transference of the particles to the receiver. Furthermore, it was found that by maintaining the temperature of the receiver such that the temperature of the thermoplastic polymer coating was maintained above the Tg of the thermoplastic polymer immediately after transfer while the receiver was separating from the element surface, the receiver would separate readily and easily from the element, while hot, without the thermoplastic polymer coating adhering to the element surface and without the prior application of a release agent to the thermoplastic polymer coating. In addition, it was further found that all of the other advantages inherent in the use of a thermoplastic polymer coated receiver in a thermally assisted transfer process were preserved by this process including the production of copies having a more uniform gloss and images having a less grainy appearance. Finally, it was possible for the first time to determine in advance, in a thermally assisted transfer process, which thermoplastic polymers could be used as receiver coating materials which would not only remove virtually all of the toner particles from the element during transfer but, at the same time, would not adhere to the element during transfer and subsequent separation of the receiver from the element and which ones would not.

Unfortunately, this technique required that the receiver surface be heated to a temperature in excess of 100° C., typically in excess of 110° C. prior to contacting the toner particles on the element surface with the thermoplastic polymer coated receiver in order to effectuate the complete or nearly complete transfer of all of the toner particles from the element surface to the receiver. Having to preheat the receiver surfaces to such high temperatures prior to contacting the toner particles with the receiver created several problems. For example, when paper was used as the substrate for the thermoplastic polymer coated receiver, heating the receiver to a temperature of approximately 100° C. or higher caused any moisture which was present in the paper to vaporize which in turn caused the paper and the overlying thermoplastic polymer coating to blister and/or buckle. Another problem inherent in having to preheat the receiver surface to such a high temperature was that the thermoplastic polymer coating on the substrate tended to delaminate from the substrate due to a reduction in the adhesion strength of the thermoplastic polymer coating to the substrate caused by such high temperatures. Still further, in those receiver sheets or webs which employed anti-curl backings composed of thermoplastic polymeric materials, such high temperatures caused the anti-curl backing to soften and adhere to the transfer rollers.

SUMMARY OF THE INVENTION

In accordance with the present invention, these prior art limitations are effectively obviated by a novel process in which dry toner particles comprising a toner binder and having a particle size of 8 micrometers or less are non-electrostatically transferred from the surface of an image-bearing element to a receiver. The process involves preheating a receiver which comprises a substrate having a coating of a semi-crystalline polyester on a surface of the substrate to a temperature ranging from approximately 70° C. to approximately 95° C. and thereafter contacting the toner particles on the element with the semi-crystalline polyester coated receiver to effectuate the transfer of the toner particles from the element to the receiver.

The semi-crystalline polyesters used as coating materials for the receivers utilized in the process of the present invention have a glass transition temperature in the range of from approximately 5° C. to 80° C., a melting temperature in the range of from approximately 40° C. to 200° C., a crystallinity of from approximately 5 to 25 percent by weight, based on the total weight of the polyester, a weight average molecular weight in the range of from approximately 10,000 to 150,000, a number average molecular weight in the range of from approximately 5,000 to 75,000 and a surface energy of from approximately 44 dynes/cm to approximately 52 dynes/cm.

Applicants have found that by utilizing as a receiver in the thermally assisted method of transferring very small toner particles from the surface of an element to a receiver, a receiver which comprises a substrate coated with a semi-crystalline polyester material described above that such fine toner particles can be transferred from the surface of the element to the semi-crystalline polyester coated receiver with virtually 100% toner transfer efficiency using the thermally assisted method of transfer without having to apply a coating or a layer of a release agent to the toner contacting surface of the semi-crystalline polyester coating on the receiver substrate prior to toner transfer in order to prevent the semi-crystalline polyester coating from sticking or adhering to the element surface during transfer of the toner particles from the surface of the element to the semi-crystalline polyester coated receiver or during the subsequent separation of the receiver from the element. Further, Applicants have found that the aforediscussed problems of blistering and buckling inherent in the use of many of the prior art receivers used in the thermally assisted method of transfer as well as the delamination and sticking problems previously discussed inherent in the use of many of the prior art receivers used in the thermally assisted method of transfer are overcome by the present process. This is due to the discovery that by utilizing as a receiver in the thermally assisted method of transfer, a receiver comprising a substrate coated with a semi-crystalline polyester material of the type disclosed herein, that such a receiver does not have to be preheated to a temperature of 100° C. or more as required in the past to effectuate the transfer of the toner particles from the element to the receiver so that all of the previously discussed problems of the past caused by the use of preheating temperatures of 100° C. or in excess thereof are obviated.

Thus, viewed from one aspect, the present invention is directed to a method of non-electrostatically transferring dry toner particles which comprise a toner binder and which have a particle size of 8 micrometers or less from the surface of an element to a receiver. The receiver comprises a substrate having a coating of a semi-crystalline polyester on a surface of the substrate. The semi-crystalline polyester has a glass transition temperature in the range of from approximately 5° C. to approximately 80° C., a melting temperature in the range of from approximately 40° C. to approximately 200° C., a crystallinity of from approximately 5 to approximately 25 percent by weight, based on the total weight of the polyester, a weight average molecular weight in the range of approximately 10,000 to 150,000, a number average molecular weight in the range of approximately 5,000 to 75,000 and a surface energy of from approximately 44 dynes/cm to approximately 52 dynes/cm.

The semi-crystalline polyester coated surface on the substrate is heated to a temperature ranging from approximately 70° C. to approximately 95° C. and the toner particles on the surface of the element are contacted with the heated semi-crystalline polyester coating whereby virtually all of the toner particles are transferred form the surface of the element to the semi-crystalline polyester coating on the receiver substrate. The element is then separated from the receiver at a temperature below or above the glass transition temperature of the semi-crystalline polyester coating. Due to the presence of the semi-crystalline polyester coating on the receiver substrate, the receiver is prevented from adhering to the surface of the element during transfer and the subsequent separation of the receiver from the element in the absence of a release agent on the semi-crystalline polyester coating.

These and other features and advantages of the present invention will be better understood taken in conjunction with the following detailed description and claims.

DESCRIPTION OF THE PREFERRED EMBODIMENT

The present invention constitutes an improvement in the thermally assisted method of non-electrostatically transferring very small toner particles from the surface of an element to a thermoplastic polymer coated receiver where the toner particles which are carried on the surface of the element are transferred non-electrostatically to the receiver which is heated, but not heated sufficiently to melt the particles. As is taught in previously mentioned U.S. Pat. No. 4,927,727, to Rimai et al, it is not necessary or desirable to melt the toner particles in order to achieve their transfer, but that merely fusing the toner particles to each other at their points of contact, i.e., localized regions on the individual toner particle surfaces which are in contact either with one another or with the surface upon which such a particle is transferred or deposited, is adequate to accomplish a complete, or nearly complete, transfer of the particles. Thus, the toner is not fixed during transfer, but instead is fixed at a separate location away from the element. In this manner, the higher temperatures required for fixing the toner do not negatively affect or damage the element. Since the heat required to merely sinter the toner particles at their points of contact is much lower than the heat needed to fix the toner, the element is not damaged by high temperatures during transfer.

The term "sinter" or "sintering" as used herein in relation to toner particles employed in the practice of the present invention has reference to bonding or fusion that is thermally achieved at locations of contact existing either between adjacent toner particles or between toner particles and an adjacent surface. The term "sinter" and equivalent forms is distinguished for present purposes from a term such as "melts", "melting", "melt", "melt fusion" or "heat fusion". In heat fusion, in response to sufficiently applied thermal energy, toner particles tend to lose their discrete individual identities and melt and blend together into a localized mass, as when a toner powder is heat fused and thereby bonded or fixed to a receiver.

The crux of the present invention resides in the fact that it has now been found that not only can very fine toner particles, i.e., toner particles having a particle size of 8 micrometers or less, and more typically, 3 to 5 micrometers, be non-electrostatically transferred with virtually 100% transfer efficiency from the surface of an element to the surface of a thermoplastic polymer coated receiver using the thermally assisted method of transfer and without the necessity of having to apply a coating or a layer of a release agent to the thermoplastic polymer coating prior to toner transfer in order to prevent the thermoplastic polymer coating from adhering to the element surface during and immediately following toner transfer when the receiver separates from the element, but further that by utilizing as the thermoplastic polymer coating for forming the toner receiving surfaces of the receivers used in the thermally assisted method of transfer certain semi-crystalline polyester materials which are described in detail below, that the surface of the thermoplastic polymer coating on the receiver does not have to be heated to temperatures as high as those previously required in the thermally assisted transfer process prior to contacting the toner particles on the element and transferring the toner particles from the element to the receiver. In the past, it was required that the thermoplastic polymer coatings used in the prior art receivers be heated to a temperature of at least 100° C. or greater in order to effectuate the complete or nearly complete transfer of the toner particles from the element to the polymer coated receiver surface. However, by utilizing as a receiver in the thermally assisted method of transfer a receiver comprising a substrate having as a coating for forming the toner receiving surface thereof, a semi-crystalline polyester material of the present invention, the surface of such a receiver only has to be preheated to a temperature of from approximately 70° C. to approximately 95° C. in order to effectuate the complete or nearly complete transfer of the toner particles from the element to the receiver. This eliminates many of the problems inherent in the use of the coating materials of the past such as the aforementioned blistering and buckling problems as well as the previously discussed delamination and sticking problems.

The semi-crystalline polyesters used as the coating materials for the receivers utilized in the present invention can be linear or branched. They can be fashioned from any of many different monomers, typically by polycondensation of monomers containing two or more carboxylic acid groups (or derivatives thereof, such as anhydride or ester groups) with monomers containing two or more hydroxy groups. However, in order to insure that the polyesters used in the practice of the present invention possess the required degree of crystallinity of from about 5 percent by weight to about 25 percent by weight, based on the total weight of the polyester, the polyesters should contain between about 50 to 100 mole percent terephthalic acid moieties. The term "degree of crystallinity" or "percentage of crystallinity" as used herein refers to the ratio of the mass of the crystalline material in the polyester to the mass of the combined crystalline and amorphous material in the polyester and is equal to the ratio of the measured heat of fusion of the purely crystalline component or portion of the polyester divided by the theoretical heat of fusion thereof. "Heat of fusion" as used herein is the amount of heat absorbed when crystalline polymers are melted. The degree of crystallinity for the semi-crystalline polyesters utilized herein can be measured by conventional means using a Differential Scanning Calorimeter. These "terephthalyl moieties" can be supplied by the usual terephthalyl moiety sources, e.g., terephthalyl acid, terephthalyl chloride and the mono- and dialkyl esters of terephthalic acid. Thus, the term "terephthalyl moiety" or "terephthalyl acid moiety" is to be considered as including those moieties supplied by the acid chloride or the mono- or diester. Thus, the polyester contains terephthalic acid in an amount of at least about 50 mole percent, based upon the acid moieties.

If desired, the terephthalic acid moiety can be replaced by about 5 to about 50 mole percent by a second acid moiety consisting of a saturated aliphatic dicarboxylic acid having terminal carboxylic acid groups having from 2 to about 30 carbon atoms between the two carboxyl groups. Preferably, the saturated aliphatic dicarboxylic acid contains from 2 to 10 carbon atoms between the carboxyl groups. Examples of aliphatic dicarboxylic acids contemplated herein include malonic acid, succinic acid, glutaric acid, adipic acid, pimelic acid, azelaic acid, sebacic acid and dodecanedioic acid. Mixtures of such dicarboxylic acids also can be used in preparing the present polyesters.

Alternatively, the terephthalic acid moiety can be replaced by about 5 to about 50 mole percent by a cyclic, aliphatic dicarboxylic acid moiety having a 4 to 7 carbon ring system in which the saturated aliphatic ring preferably contains 6 carbon atoms and the carboxylic acid groups are in the para positions. The cyclic, aliphatic dicarboxylic acid moiety may consist either of the cis or trans isomers or a mixture of the cis and trans isomers. Particularly useful cyclic, aliphatic dicarboxylic acid moieties include 1,4-dimethyl-cyclohexane dicarboxylate and 2,6-naphthalene dicarboxylate.

Still further, the terephthalic acid moiety can be replaced by about 5 to 50 mole percent based on the total acid moieties of an aromatic dicarboxylic acid isomer in which the carboxylic acid groups are either ortho or meta to each other. A particularly useful aromatic dicarboxylic acid isomer is isophthalic acid.

The polyol component of the polyesters utilized in the practice of the present invention can be selected from a wide variety of diols. Typical of the suitable diols are those having the formula HO-R-OH wherein R is a divalent organic radical generally having about 2 to 12 carbon atoms, as well as hydrogen atoms and ether oxygen atoms, e.g., 1) a hydrocarbon radical such as an alkylene radical, a cyclohexane radical, a 1,4-dimethylenecyclohexane radical, a phenylene radical, a 1,4-dialkylenecyclohexane radical, or a 2,2-dimethylpropylene radical; 2) an alkylene-O-alkyleneradical; and 3) an alkylene-O-cyclohexane-O-alkyleneradical. Exemplary diols that can be used in preparing the polyesters of the present invention include: ethylene glycol, diethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,12-dodecanediol, neopentyl glycol, 1,4-cyclohexanedimethanol and 1,4-di-β-hydroxyethoxycyclohexane. Mixtures of such diols also may be used in preparing the present polyesters.

In addition, various triols and/or tetrols can be used in preparing the polyesters utilized in the present invention to create branching in the polyesters. Examples of these include pentaerythritol, trimethylolpropane, sorbitol, glycerol and the like. The tri- or higher valent alcohols, however, should only be present in an amount up to about 10 mole percent based upon the total polyol components in order to preserve the requisite degree of crystallinity in the polyester of from about 5 to about 25 percent by weight based on the total weight of the polyester.

Especially preferred semi-crystalline polyesters for use as coating materials for the receivers used in the practice of the present invention include poly[hexamethylene-co-tetramethylene (80/20) terephthalate-co-isophthalate (80/20)], 10 percent to 12 percent crystalline by weight and poly[hexamethylene-co-tetramethylene (80/20) terephthalate] 10 percent to 20 percent crystalline by weight. A particularly preferred polymer is poly[2,2'-oxy-diethylene-co-ethylene (37/63) terephthalate], 5 percent to 8 percent crystalline by weight.

The semi-crystalline polyesters utilized in the present invention can be produced by the condensation polymerization of polyvalent carboxylic acid components and polyol components at approximately 180° C. to 250° C. in an inert atmosphere. The reaction may be accelerated by the aid of commonly used esterification catalysts such as zinc oxide, stannous oxide, dibutyltin oxide and dibutyltin dilaurate. Also, the reaction may be carried out under reduced pressure.

The degree of polyesterification can be monitored by measuring the inherent viscosity (iv) of samples taken at varying intervals during the polyesterification reaction. Inherent viscosity of these polyesters is measured in a solution composed of a 1:1 weight ratio of phenol and chlorobenzene at 25° C. using a 0.25 weight percent polyester concentration. The inherent viscosity of the polyesters utilized in the practice of the present invention should be in the range of about 0.1 to about 0.6 dl/g. After reaching the desired inherent viscosity, the polyester is cooled and isolated.

Many of the semi-crystalline polyesters which can be utilized in the practice of the present invention are presently available commercially and include, for example, Eastotac® resins, grades FA300 and FA250, and Kodabond®, grade PETG5116 which are available from Eastman Kodak Company.

As mentioned previously, the semi-crystalline polyesters utilized in the practice of the present invention should have a glass transition temperature in a range of from approximately 5° C. to approximately 80° C. The term "glass transition temperature" or "Tg" as used herein means the temperature or temperature range at which a polymer changes from a solid to a viscous liquid or rubbery state. This temperature can be measured by differential thermal analysis as disclosed in *Mott, N. F. and Davis. E. A. Electronic Processes and Non-Crystalline Material* Belfast, Oxford University Press, 1971, p. 192. Semi-crystalline polyesters having a Tg lower than approximately 5° C. may be too soft or tacky at ambient temperature and present handling and storage problems while those having a Tg higher than about 80° C. may not soften enough during the preheating of the receiver to pick-up or remove all of the toner particles from the element during transfer.

The semi-crystalline polyesters utilized in the practice of the present invention also should have a melting temperature in a range of from approximately 40° C. to approximately 200° C. "Melting temperature" or "$T_m$" as used herein is defined as the temperature at which a polymer changes from a crystalline state to a liquid state. This temperature ($T_m$) can be measured by differential thermal analysis as disclosed in "Techniques and Methods of Polymer Evaluation," Vol. 1, Marcel Dekker, Inc., N.Y. 1966. Semi-crystalline polyesters having a $T_m$ lower than about 40° C. are undesirable in that they are too soft or tacky at ambient temperature and present handling and storage problems while those having a Tm higher than about 200° C. may not soften enough during preheating of the receiver to pick-up or remove all of the toner particles from the element during toner transfer.

The semi-crystalline polyesters utilized in the practice of the present invention, i.e., the semi-crystalline polyester coatings on the receiver substrates utilized in the practice of the present invention also should have a surface energy in a range of from approximately 44 dynes/cm to approximately 52 dynes/cm. Semi-crystalline polyesters having a surface energy lower than approximately 44 dynes/cm may not pick-up toner particles because deformation of the polyester is too small to allow sufficient contact of the toner with the receiver, while semi-crystalline polyesters having a surface energy higher than approximately 52 dynes/cm tend to adhere to the element during toner transfer and will not subsequently separate therefrom. The term "surface energy" as used herein is defined as the energy needed or required to create a unit surface area of a material to an air interface. The surface energy can be measured by determining the contact angles of droplets of two dissimilar liquids, e.g., diiodomethane and distilled water. These measured angles are then used to calculate the total surface energy using the Girifalco and Good approximation. This method is described in detail in Fowkes, F. "Contact Angle, Wettability and Adhesion" in *Advances in Chemistry Series* (Washington, D.C., American Chemical Society, 1964) pp. 99–111.

As previously mentioned, the semi-crystalline polyesters utilized in the practice of the present invention should have a weight average molecular weight in a range of from approximately 10,000 to approximately 150,000 and a number average molecular weight in a range of from approximately 5,000 to approximately 75,000. Semi-crystalline polyester having a weight average molecular weight below approximately 10,000 or a number average molecular weight below approximately 5,000 may be too brittle and crack. In addition, semi-crystalline polyesters having a weight average molecular weight higher than approximately 150,000 or a number average molecular weight higher than approximately 75,000 exhibit poor flow characteristics and do not offer any significant additional benefits for the additional expense incurred.

As previously mentioned, the semi-crystalline polyester utilized in the practice of the present invention, should have a degree of crystallinity of from approximately 5 to 25 percent by weight based on the total weight of the polyester. Semi-crystalline polyesters having a degree of crystallinity less than approximately 5 weight percent would have to be preheated to temperatures of 100° or more prior to toner transfer which would negate the benefits and advantages of the receivers used in the practice of the present invention while those having a degree of crystallinity of more than approximately 25 percent by weight will not soften sufficiently to effectuate the transfer of toner particles from the element to the receiver surface. The term "degree of crystallinity" has been defined previously herein.

The significance of the interrelationship between the semi-crystalline polyester coating materials and process conditions utilized in the practice of the present invention is demonstrated by the fact that it was found that when receivers were used in the thermally assisted method of toner transfer which had a coating of a semi-crystalline polyester which possessed all of the afore-identified properties except for the fact that the polyester was only 30% crystalline by weight (i.e., not within the required range of crystallinity), the receiver separated from the element but only about two-thirds of the toner particles transferred from the element to the receiver and the receiver blistered during fusing. Another example illustrating the interrelationship between the required properties of the semi-crystalline polyester coating materials and the process conditions utilized in the practice of the present invention is demonstrated by the fact that it was found that when receivers were used in the thermally assisted method of toner transfer which had a coating comprising a semi-crystalline polyester material possessing all of the afore-identified properties required of the semi-crystalline polyester materials used in the practice of the present invention, but the receiver surface was only preheated to a temperature of 30° C. (i.e., not within the required preheating temperature range utilized in the present process) good separation was obtained after toner transfer but unacceptable transfer efficiency was observed. In contrast, when receivers were used in the thermally assisted method of toner transfer whose semi-crystalline polyester coatings possessed all of the required properties aforedescribed and were preheated to temperatures within the specified range of approximately 70° C. to 95° C., that the semi-crystalline polyester coatings did not adhere to the element during or subsequent to toner transfer and virtually 100% of the toner particles were transferred from the element to the receiver.

A receiver substrate is required in this invention because the semi-crystalline polyester coating softens during transfer and subsequent fixing of the toner particles to the receiver. Without a substrate, the semi-crystalline polyester coating would warp or otherwise distort, destroying the images. Almost any type of substrate can be used to make the coated receiver used in this invention, including paper, film, and particularly transparent film, which is useful in making transparencies. The substrate must not melt, soften, or otherwise lose its mechanical integrity during transfer or fixing of the toner. A good substrate should not absorb the semi-crystalline polyester, but should permit the polyester coating to stay on its surface and form a good bond to the surface. Substrates having smooth surfaces will, of course, result in a better image quality. A flexible substrate is particularly desirable, or even necessary, in many electrostatographic copy machines. In addition to the foregoing requirements, the semi-crystalline polyester coating must adhere sufficiently to the substrate so that it will not peel off when the receiver is heated. Also, it must adhere sufficiently to the toner particles so that the toner particles will transfer to the receiver. The semi-crystalline polyester coating should be abrasion resistant and flexible enough so that it will not crack when the receiver is bent. The semi-crystalline polyester should not shrink or expand very much so that is does not warp the receiver or distort the image, and it is preferably transparent so that is does not detract from the clarity of the image.

The thermoplastic semi-crystalline polyester coating on the receiver can be formed in a variety of ways, including solvent coating, extruding, and spreading from a water latex. The resulting thermoplastic polymer coating on the substrate is preferably approximately 2 to 30 micrometers in thickness, and more preferably approximately 5 to 20 micrometers in thickness, as thinner layers may be insufficient to transfer all of the toner from the element and thicker layers are unnecessary and may result in warpage of the receiver, may tend to delaminate, may embrittle, or may result in a loss of image sharpness.

In the process of this invention, the receiver is preheated to a temperature such that the temperature of the receiver during transfer will be adequate to fuse the toner particles at their points of contact, but will not be high enough to melt the toner particles, or to cause contacting toner particles to coalescence or flow together into a single mass. It is important that the receiver is preheated to a temperature such that the transfer temperature of the semi-crystalline polyester coating on the substrate is between approximately 45° C. and approximately 58° C. when the coating on the receiver surface contacts the toner-bearing element in the nip. This generally involves preheating the receiver to a temperature in a range of from approximately 70° C. to approximately 95° C. If the transfer temperature is not maintained within this range good transfer efficiencies and/or complete separation of the receiver and the element will not result. If the temperature of the semi-crystalline polyester coating of the receiver during transfer is below approximately 45° C., less than 80%, and more typically less than 50%, of the toner particles will transfer from the element surface to the receiver, and if the temperature during transfer is above approximately 58° C., then the semi-crystalline polyester coating on the receiver will not separate from the element.

Although either side of the receiver can be heated, it is preferable to conductively heat only the back surface of the receiver, i.e., the substrate surface or side of the receiver which does not contact the toner particles. This can be done, for example, by contacting the back surface of the receiver with a hot shoe or a heated compression roller. The semi-crystalline polyester coating side of the receiver can be heated by using a non-conductive source of heat such as, for example, one or more heat lamps, or an oven. Contact heating of the back side of the receiver is preferred, however, because it is easier to control the temperature of the surface of the receiver, damage to the receiver is less likely and it is more efficient. The length of time during which the receiver is in the nip region when the toner particles are being contacted with the receiver and transferred to the semi-crystalline polyester coating on the substrate is brief, i.e., typically less than 0.25 second, and usually 0.1 second or less. A backup roller, which presses the receiver against the element can be used to heat the receiver. The receiver must be wrapped around the backup roller sufficiently so that the receiver is heated to the proper temperature before it enters the nip. The backup or compression rollers which can be used in the practice of the process of the present invention to create an appropriate nip for acceptable toner transfer can be hard or compliant (i.e., resilient) rollers.

As with any thermally assisted method of transfer, it has been found that pressure aids in the transfer of the toner to the receiver, and an average force of approximately $5.3\times10^3$ N/m to approximately $8.8\times10^3$ N/m, along the length of the pressure roller is preferred when a roller nip region is used to apply such pressures, or when such pressures are applied by a platen or equivalent. Lower pressures may result in less toner being transferred and higher pressures may damage the element and can cause slippage between the element and the receiver thereby degrading the image. The pressure is exerted against the substrate side of the receiver which is the side of the receiver farthest from the element surface from which the toner particles are transferred.

Immediately after transfer is complete, the receiver and the element are separated while still hot.

In any case, the toner must not be fixed during transfer but must be fixed instead at a separate location that is not in contact with the element. In this way, the element is not exposed to high temperatures and the toner is not fused to the element.

Typically, after transfer of the toner particles from the element to the receiver and subsequent separation of the receiver from the element, the developed toner image is heated to a temperature sufficient to fuse it to the receiver. A present preference is to heat the image-bearing semi-crystalline polyester coating surface on the receiver until it reaches or approaches its glass transition temperature and then place it in contact with a heated ferrotyping material which raises the temperature or maintains it above its glass transition temperature while a force is applied which urges the ferrotyping material toward the semi-crystalline polyester thermoplastic layer with sufficient pressure to completely or nearly completely embed the toner image in the heated layer. This serves to substantially reduce visible relief in the image and impart a smoothness to the coated layer on the receiver. The ferrotyping material, which conveniently can be in the form of a web or belt, and the receiver sheet can be pressed together by a pair of pressure rollers, at least one of which is heated, to provide substantial pressure in the nip. A pressure of at least approximately $2.6\times10^3$ N/m along the length of the pressure rollers should be applied, however, better results are usually achieved with pressures of approximately $5.3\times10^3$ N/m to $8.8\times10^3$ N/m. The ferrotyping web or belt can be made of a number of materials including both metals and plastics. For example, a highly polished stainless steel belt, as electroformed nickel belts, and a chrome plated brass belt both have good ferrotyping and good release characteristics. In general, better results are obtained, however, with conventional polymeric support materials such as polyester, cellulose acetate and polypropylene webs, typically having a thickness of approximately 2 to 5 milliliters. Materials marketed under the trademarks Estar® and Mylar® by E. I. DuPont de Nemorus Company and a polyamide film distributed by Dupont under the trademark Kapton-H®, which optionally can be coated with a release agent to enhance separation, are especially useful ferrotyping materials. In addition, metal belts coated with heat resistant, low surface energy polymers, such as highly crosslinked polysiloxanes, also are effective ferrotyping materials. After the image-bearing surface has been contacted with the ferrotyping material and the toner image has been embedded in the heated thermoplastic coating or layer, the layer is allowed to cool to well below its glass transition temperature while it is still in contact with the ferrotyping material. After cooling, the layer is separated from the ferrotyping material.

Either halftone or continuous tone images can be transferred with equal facility using the process of this invention. Because the electrostatic image on the element is not significantly disturbed during transfer it is possible to make multiple copies from a single image-wise exposure.

Toners useful in the practice of this invention are dry toners having a particle size of 8 micrometers or less and preferably 5 micrometers or less. The toners must contain a thermoplastic binder in order to be fusible.

The polymers useful as toner binders in the practice of the present invention can be used alone or in combination and include those polymers conventionally employed in electrostatic toners. Useful polymers generally have a Tg of from about 40° C. to 120° C., preferably from about 45° C. to 65° C. Preferably, toner particles prepared from these polymers have a relatively high caking temperature, for example, higher than about 60° C., so that the toner powders can be stored for relatively long periods of time at fairly high temperatures without having individual particles agglomerate and clump together. The melting point or temperature of useful polymers preferably is within the range of from approximately 65° C. to approximately 200° C. so that the toner particles can readily be fused to the receiver to form a permanent image. Especially preferred polymers are those having a melting point within the range of from approximately 65° to approximately 130° C.

Among the various polymers which can be employed in the toner particles of the present invention are polycarbonates, resin-modified maleic alkyd polymers, polyamides, phenol-formaldehyde polymers and various derivatives thereof, polyester condensates, modified alkyd polymers, aromatic polymers containing alternating methylene and aromatic units such as described in U.S. Pat. No. 3,809,554 and fusible crosslinked polymers as described in U.S. Reissue Pat. No. 31,072.

Typical useful toner polymers include certain polycarbonates such as those described in U.S. Pat. No. 3,694,359, which include polycarbonate materials containing an alkylidene diarylene moiety in a recurring unit and having from 1 to 10 carbon atoms in the alkyl moiety. Other useful polymers having the above-described physical properties include polymeric esters of acrylic and methacrylic acid such as poly(alkyl acrylate), and poly(alkyl methacrylate) wherein the alkyl moiety can contain from 1 to 10 carbon atoms. Additionally, other polyesters having the aforementioned physical properties also are useful. Among such other useful polyesters are copolyesters prepared from terephthalic acid (including substituted terephthalic acid), a bis(hydroxyalkoxy)phenylalkane having from 1 to 4 carbon atoms in the alkoxy radical and from 1 to 10 carbon atoms in the alkane moiety (which also can be a halogen-substituted alkane), and an alkylene glycol having from 1 to 4 carbon atoms in the alkylene moiety.

Other useful polymers are various styrene-containing polymers. Such polymers can comprise, e.g., a polymerized blend of from approximately 40 to 100% by weight of styrene, from 0 to approximately 45% by weight of a lower alkyl acrylate or methacrylate having from 1 to 4 carbon atoms in the alkyl moiety such as methyl, ethyl, isopropyl, and butyl, and from approximately 5 to 50% by weight of another vinyl monomer other than styrene, for example, a higher alkyl acrylate or methacrylate having from 6 to 20 or more carbon atoms in the alkyl group. Typical styrene-containing polymers prepared from a copolymerized blend as described hereinabove are copolymers prepared from a monomeric blend of 40 to 60% by weight styrene or styrene homolog, from approximately 20 to 50% by weight of a lower alkyl acrylate or methacrylate and from approximately 5 to 30% by weight of a higher alkyl acrylate or methacrylate such as ethylhexyl acrylate (e.g., styrene-butyl acrylate-ethylhexyl acrylate copolymer). Preferred fusible styrene copolymers are those which are covalently crosslinked with a small amount of a divinyl compound such as divinylbenzene. A variety of other useful styrene-containing toner materials are disclosed in U.S. Pat. Nos. 2,917,460; Re 25,316; 2,788,288; 2,638,416; 2,618,552 and 2,659,670. Especially preferred toner binders are polymers and copolymers of styrene or a derivative of styrene and an acrylate, preferably butylacrylate.

Useful toner particles can simply comprise the polymeric particles but it is often desirable to incorporate addenda in the toner such as waxes, colorants, release agents, charge control agents, and other toner addenda well known in the art. The toners can also contain magnetizable material, but such toners are not preferred because they are available in only a few colors and it is difficult to make such toners in the small particle sizes required in this invention.

If a colorless image is desired, it is not necessary to add colorant to the toner particles. However, more usually a visibly colored image is desired and suitable colorants selected from a wide variety of dyes and pigments such as disclosed for example, in U.S. Reissue Pat. No. 31,072 are used. A particularly useful colorant for toners to be used in black-and-white electrophotographic copying machines is carbon black. Colorants in the amount of approximately 1 to 30 percent, by weight, based on the weight of the toner can be used. Often, approximately 8 to 16 percent, by weight, of colorant is employed.

Charge control agents suitable for use in toners are disclosed for example in U.S. Pat. Nos. 3,893,935; 4,079,014; 4,323,634 and British Pat. Nos. 1,501,065 and 1,420,839. Charge control agents are generally employed in small quantities such as approximately 0.01 to approximately 3 weight percent, frequently approximately 0.1 to 1.5 weight percent, based on the total weight of the toner.

Toners used in this invention can be mixed with a carrier vehicle. The carrier vehicles, which can be used to form suitable developer compositions, can be selected from a variety of materials. Such materials include carrier core particles and core particles overcoated with a thin layer of film-forming resin. Examples of suitable resins are described in U.S. Pat. Nos. 3,547,822; 3,632,512; 3,795,618; 3,898,170; 4,545,060; 4,478,925; 4,076,857; and 3,970,571.

The carrier core particles can comprise conductive, non-conductive, magnetic, or non-magnetic materials, examples of which are disclosed in U.S. Pat. Nos. 3,850,663 and 3,970,571. Especially useful in magnetic brush development schemes are iron particles such as porous iron particles having oxidized surfaces, steel particles, and other "hard" or "soft" ferromagnetic materials such as gamma ferric oxides or ferrites, such as ferrites of barium, strontium, lead, magnesium, or aluminum. See for example, U.S. Pat. Nos. 4,042,518; 4,478,925; and 4,546,060.

The very small toner particles that are required in this invention can be prepared by a variety of processes well-known to those skilled in the art including spray-drying, grinding, and, most suitably, suspension polymerization which is described in detail, for example, in U.S. Pat. Nos. 4,965,131, 4,835,084 and 4,844,060 all of which are incorporated herein by reference.

As indicated above, the process of this invention is applicable to the formation of color copies. If a color copy is to be made, successive latent electrostatic images are formed on the element, each representing a different color, and each image is developed with a toner of a different color and is transferred to a receiver. Typically, but not necessarily, the images will correspond to each of the three primary colors, and black as a fourth color, if desired. After each image has been transferred to the receiver, it can be fixed on the receiver, although it is preferable to fix all of the transferred images together in a single step. For example, light reflected from a color photograph to be copied can be passed through a filter before impinging on a charged photoconductor so that the latent electrostatic image on the photoconductor corresponds to the presence of yellow in the photograph. That latent image can be developed with a yellow toner and the developed image can be transferred to a receiver. Light reflected from the photograph can then be passed through another filter to form a latent electrostatic image on the photoconductor which corresponds to the presence of magenta in the photograph and that latent image can then be developed with a magenta toner which can be transferred to the same receiver. The process can be repeated for cyan (and black, if desired) and then all of the toners on the receiver can be fixed in a single step.

The image-bearing element from which the toner particles are transferred upon contact with the semicrystalline thermoplastic polymer coated receiver of the invention can include any of the electrostatographic elements well known in the art, including electrophotographic or dielectric elements such as dielectric recording elements. The element can be in the form of a drum, a belt, a sheet or other shape and can be single use or a reusable element. Reusable elements are preferred because they are generally less expensive. Reusable elements must be thermally stable at the temperature of transfer. Examples of suitable polymers which may comprise the surface layer of an electrostatographic element are the condensation polymers of polyester or polycarbonate resins, including poly[4,4'-(2-norbornylidene)bis-phenylene azelate-co-terephthalate (60/40)] and poly[4,4'-(2-isopropylidene)bisphenylene carbonate]. Examples of other useful polyester and/or polycarbonate binder resins which may be suitable include those disclosed in U.S. Pat. Nos. 4,284,699, 4,175,960, 3,615,414, 4,350,751, 3,679,407, 3,684,502 and 3,873,311. A presently preferred photoconductive element is a near infrared sensitive inverted multi-layer photoconductive element made from fluorine-substituted titanyl tetrafluorophthalocyanine pigments which is disclosed in U.S. Pat. No. 4,701,396. Also best results are achieved if the element has a surface energy less than about 47 dynes/cm.

The invention is illustrated by the following examples.

EXAMPLE 1

A semi-crystalline polyester, poly[hexamethylene-co-tetramethylene (80/20) terephthalate], was prepared and coated onto a paper receiver as follows.

Into a 1-liter, single-neck round bottom glass flask equipped with a thermometer, a glass nitrogen inlet, a stainless steel stirrer and a Claisen head were placed 291 grams (1.5 moles) of dimethylterephthalate, 141.6 grams (1.2 moles) of 1,6-hexanediol, 36 grams (0.40 mole) of 1,4-butanediol and approximately 200 ppm of tetraisopropyl titanate catalyst based on the total weight of the monomers. With the flask heated in a salt water bath, the reactants underwent reaction at a temperature ranging from approximately 200° C. to approximately 240° C. for a period of time of approximately four hours under normal pressure in a nitrogen atmosphere.

The resulting condensation polymer was then polycondensed in the melt phase in the same reactor with stirring at approximately 240° C. and 0.1 mm Hg until the polyester achieved an inherent viscosity of 0.74 dl/g as measured in a solution composed of a 1:1 weight ratio of phenol and chlorobenzene at 25° C. using a 0.25 weight percent polyester concentration. The semi-crystalline polyester had a glass transition temperature of 25° C., a melting temperature of 125° C., a weight average molecular weight of 62,000, a number average molecular weight of 28,000 and a crystallinity of 20 percent by weight based on the total weight of the polyester. The polyester was melt extruded onto a paper substrate under conditions resulting in a thermoplastic polymer coated receiver having a surface energy of 47 dynes/cm. The thickness of the thermoplastic polymer coating on the substrate was approximately 10 micrometers.

EXAMPLE 2

A semi-crystalline polyester, poly[hexamethylene-co-tetramethylene (80/20) terephthalate-co-isophthalate (80/20)], was prepared in the manner of Example 1 from 232.8 grams (1.2 moles) of dimethylterephthalate, 58.2 grams (0.30 mole) of dimethylisophthalate, 141.6 grams (1.2 moles) of 1,6-hexanediol, 36 grams (0.40 mole) of 1,4-butanediol and approximately 200 ppm tetraisopropyl titanate catalyst. The resultant semi-crystalline polyester had an inherent viscosity of 0.52 dl/g, a glass transition temperature of 15° C., a melting temperature of 100° C., a weight average molecular weight of 56,000, a number average molecular weight of 24,000 and a crystallinity of 12% based on the total weight of the polyester. The semi-crystalline polyester was melt extruded onto a paper substrate under conditions resulting in a thermoplastic coated receiver having a surface energy of 48 dynes/cm. The thickness of the thermoplastic polymer coating on the substrate was approximately 10 micrometers.

EXAMPLE 3

A semi-crystalline polyester, poly[2,2'-oxydiethylene-co-ethylene (37/63) terephthalate], was prepared in the manner of Example 1 from 291 grams (1.5 moles) of dimethylterephthalate, 70.1 grams (1.13 moles) of ethylene glycol, 71.2 grams (0.67 mole) of 2,2'-oxydiethanol and approximately 200 ppm of tetraisopropyl titanate catalyst based on the total weight of the monomers. The resultant semi-crystalline polyester had an inherent viscosity of 0.62 dl/g, a glass transition temperature of 57° C., a melting temperature of 180° C., a weight average molecular weight of 68,000, a number average molecular weight of 32,000 and a crystallinity of 5% based on the total weight of the polyester. The semi-crystalline polyester was melt extruded onto a paper substrate under conditions resulting in a thermoplastic polymer coated receiver having a surface energy of approximately 45 to 50 dynes/cm, the thickness of the thermoplastic polymer coating on the substrate was approximately 10 micrometers.

EXAMPLE 4

A semi-crystalline polyester, poly[tetramethylene 1,4-cyclohexane dicarboxylate-co-terephthalate (20/80)], was prepared in the manner of Example 1 from 232.8 grams (1.2 moles) of dimethylterephthalate, 60 grams (0.30 mole) of dimethyl-1,4-cyclohexane dicarboxylate, 162 grams (1.8 moles) of 1,4-butanediol and approximately 200 ppm of tetraisopropyl titanate catalyst. The resultant semi-crystalline polyester had an inherent viscosity of 0.63 dl/g, a glass transition temperature of 58° C., a melting temperature of 195° C., a weight average molecular weight of 70,000, a number average molecular weight of 30,000 and a crystallinity of 30% based on the total weight of the polyester. The semi-crystalline polyester was melt extruded onto a paper substrate under conditions resulting in a thermoplastic polymer coated receiver having a surface energy of 45 dynes/cm. The thickness of the thermoplastic polymer coating on the substrate was approximately 10 micrometers.

EXAMPLE 5

The process of the present invention was carried out as follows.

Three toner images consisting of density tablets were generated by standard electrographic techniques on the surface of an inverted multi-layer photoconductive element which had a toner contacting surface comprising a poly[4,4'-(2-norbornylidene)bisphenoxy azelate-co-terephthalate] polyester binder resin and a surface energy of approximately 45 dynes/cm and transferred sequentially and in registration to simulate the formation of a full color image to a receiver using the thermally assisted method of transfer. The receiver comprised a paper substrate coated with approximately 10 micrometers of poly[hexamethylene-co-tetramethylene (80/20) terephthalate-co-isophthalate (80/20)] prepared in the manner of Example 2. The semi-crystalline polyester coated on the receiver substrate had an inherent viscosity of 0.52 dl/g, a glass transition temperature of 15° C., a melting temperature of 100° C., a weight average molecular weight of 56,000, a number average molecular weight of 21,000, a crystallinity of 12% based on the total weight of the polyester and a surface energy of 48 dynes/cm. The electrostatic image was developed with a dry electrographic toner in combination with a magnetic carrier consisting of a polymer coated ferrite core material approximately 30 micrometers in diameter. The toner particles were comprised of a styrene-butylacrylate binder having a glass transition temperature of 62° C., a mean volume weighted diameter of approximately 3 to 4 micrometers, and containing a positively-charging charge-control agent and a bridged aluminum phthalocyanine pigment. The toner particles were prepared by the limited coalescence technique.

Transfer was accomplished by passage through the nip region of a pair of compression rollers. The roller containing the substrate side or face of the receiver opposite the thermoplastic polymer coated side or face of the receiver was heated to a temperature of approximately 95° C. while the other roller which contacted the face or side of the element opposite the element surface on which the toner particles were carried was at ambient temperature so that the front surface of the receiver, i.e., the thermoplastic polymer coating was heated to a temperature that was about 95° C. prior to transfer. The temperature of the thermoplastic polymer coating during transfer was approximately 58° C. The heated roller was a chrome-plated steel roller and the non-heated roller comprised an aluminum core coated with Teflon ®. The passage speed was 3.18 cm/second. Air pressure to the unheated compression roller was of a magnitude sufficient to create a force at the nip of $7.0\times10^3$ N/m along the length of the transfer rollers. During passage through the nip region of the rollers, the heated front surface of the receiver, i.e. the thermoplastic polymer coating, was contacted with the toner particles on the surface of the photoconductive element and the particles transferred to the receiver. The receiver and the photoconductive element were separated immediately after transfer while hot and prior to fixing the transferred image. After transfer, the toner image was ferrotyped by casting it against a sheet of Kapton-H and passing the thermoplastic polymer coated receiver bearing the transferred toner image partially embedded in the surface thereof and the Kapton-H through a pair of hard compression rollers oppositely rotating with respect to each other one of which was heated to a temperature of approximately 110° C. and the other being unheated. The ferrotyping sheet contacted the heated roller. The process speed was approximately 0.5 cm/second.

Sequential transfer of the three images in register was excellent and the element readily separated from the receiver after the transfer process was completed. The efficiency, i.e. the percentage of toner that transferred from the element to the receiver, was greater than 99.9 percent. No damage to either the photoconductor or the receiver was observed.

EXAMPLE 6

Example 5 was repeated except that only a single toned image was transferred from the element to the receiver. Transfer efficiency was approximately 99 percent and the element readily separated from the receiver after the transfer process was completed.

EXAMPLE 7

Example 6 was repeated except that the thermoplastic polymer coating on the receiver substrate consisted of poly[hexamethylene-co-tetramethylene (80/20) terephthalate] prepared in the manner of Example 1 having an inherent viscosity of 0.74 dl/g, a glass transition temperature of 25° C., a melting temperature of 125° C., a weight average molecular weight of 62,000, a number average molecular weight of 28,000, a crystallinity of 20 percent by weight based on the total weight of the polyester and a surface energy of 47 dynes/cm. Transfer efficiency was approximately 99 percent and the element readily separated from the receiver after the transfer process was completed.

EXAMPLE 8

Example 5 was repeated except that the thermoplastic polymer coating on the receiver substrate was a commercially available polyester, namely poly[2,2'-oxydiethylene-co-ethylene (37/63) terephthalate], having an inherent viscosity of 0.62 dl/g, a glass transition of temperature of approximately 57° C., a melting temperature of 180° C., a weight average molecular weight of 68,000, a number average molecular weight of 32,000, a crystallinity of 5 percent by weight, based on the total weight of the polyester, and a surface energy of approximately 45 to 50 dynes/cm marketed under the name "Kodabond 5116" by Eastman Kodak Company. In addition, the pressure in the nip was $5.2\times10^3$ N/m along the length of the transfer rollers instead of $7.0\times10^3$ N/m as in the case of Example 5 and the receiver was preheated to a temperature of 85° C. corresponding to a transfer temperature of 53° C. instead of being preheated to a temperature of 95° C. corresponding to a transfer temperature of 58° C. as in the case of Example 5. Transfer efficiency was approximately 99 percent and the element readily separated from the receiver after the transfer process was completed.

EXAMPLE 9

Example 8 was repeated except that the receiver was preheated to a temperature of 90° C., the pressure at the nip was $7.0\times10^3$ N/m along the length of the transfer rollers and only a single toned image was transferred from the element to the receiver. Transfer efficiency was approximately 99 percent and the element readily separated from the receiver after the transfer process was completed.

EXAMPLE 10

Example 9 was repeated except that the pressure at the nip was $3.5\times10^3$ N/m along the length of the transfer rollers and the receiver was preheated to a temperature of 80° C., corresponding to a transfer temperature of 50° C. Transfer efficiency was approximately 99 percent and the element readily separated from the receiver after the transfer process was completed.

COMPARATIVE EXAMPLE 11

Example 6 was repeated except that the thermoplastic polymer coating on the receiver substrate was poly[tetramethylene 1,4-cyclohexane dicarboxylate-co-terephthalate (20/80)], prepared in the manner described in Example 4 having an inherent viscosity of 0.63 dl/g, a glass transition temperature of 58° C., a melting temperature of 195° C., a weight average molecular weight of 70,000, a number average molecular weight of 30,000, a crystallinity of 30 percent based on the total weight of the polyester, and a surface energy of 45 dynes/cm. In addition, the receiver was preheated to a temperature of 90° C. instead of 95° C. as in the case of Example 6. Good separation of the element from the receiver was observed, however, only about two-thirds of the toner transferred from the element to the receiver with some areas of the receiver showing even poorer efficiency. In addition, the receiver blistered during fusion. This example is outside the scope of the invention because the degree of crystallinity of the polyester exceeded that required for the polyesters used in the practice of the present invention.

COMPARATIVE EXAMPLE 12

Example 9 was repeated except that the receiver was preheated to a temperature of 30° C. Good separation of the element from the receiver was observed, but transfer efficiency was very poor. This example is outside the scope of the invention because the receiver was not preheated to a temperature within the range required in the practice of the present invention and illustrates that pressure alone without sufficient preheating of the receiver will not result in acceptable transfer.

The invention has been described in detail with particular reference to preferred embodiments thereof, but it will be understood that variations and modifications can be effected within the spirit and scope of the invention.

We claim:

1. A method of non-electrostatically transferring dry toner particles which comprise a toner binder and which have a particle size of 8 micrometers or less from an element to a receiver which comprises:

A. heating a receiver which comprises:

1. a substrate;
2. a coating of a semi-crystalline polyester on a surface of the substrate wherein said semi-crystalline polyester has a glass transition temperature of from approximately 5° C. to 80° C., a melting temperature of from approximately 40° C. to 200° C. a crystallinity of from approximately 5 to 25 percent by weight, based on the total weight of the polyester, a weight average molecular weight of from approximately 10,000 to 150,000, a number average molecular weight of from approximately 5,000 to 75,000 and a surface energy of from 44 dynes/cm to approximately 52 dynes/cm to a temperature of from approximately 70° C. to approximately 95° C.;

B. contracting said toner particles on said element with said semi-crystalline polyester coated receiver whereby virtually all of said toner particles are transferred from the surface of said element to said semi-crystalline polyester coating on said receiver; and C. separating said receiver from said element.

2. The method of claim 1, wherein said receiver substrate is paper.

3. The method of claim 1, wherein said receiver substrate is a transparent film.

4. The method of claim 1, wherein said receiver substrate is flexible.

5. The method of claim 1, wherein said semi-crystalline polyester is derived from an acid moiety and a diol moiety, at least 50 mole percent of the acid moiety being a terephthalic acid moiety and said diol moiety having the formula HO—R—OH where R is a divalent organic radical having from 2 to 12 carbon atoms.

6. The method of claim 5, wherein 5 to 50 mole percent of the acid moieties are acid moieties other than terephthalic acid moieties.

7. The method of claim 6, wherein the polyester contains moieties of isophthalic acid.

8. The method of claim 5, wherein said semi-crystalline polyester is poly[hexamethylene-co-tetramethylene (80/20) terephthalate].

9. The method of claim 5, wherein said semi-crystalline polyester is poly[hexamethylene-co-tetramethylene (80/20) terephthalate-co-isophthalate (80/20)].

10. The method of claim 5, wherein said semi-crystalline polyester is poly[2,2'-oxydiethylene-co-ethylene (37/63) terephthalate].

11. The method of claim 5, wherein said semi-crystalline polyester is poly[tetramethylene 1,4-cyclohexane dicarboxylate-co-terephthalate (20/80)].

12. The method of claim 1, wherein said toner binder has a glass transition temperature of 40° C. to 120° C.

13. The method of claim 1, wherein said toner particles are transferred to said receiver from a photoconductive element having a surface layer which comprises a polyester thermoplastic polymeric resin matrix.

14. The method of claim 13, wherein said polyester resin is poly[4,4'-(2-norbornylidene)bisphenoxy azelate-co-terephthalate].

15. A method of transferring dry toner particles which comprise a toner binder and which have a particle size of 8 micrometers or less from an element to a receiver which comprises:

A. heating a receiver which comprises:

1. a substrate;
2. a coating of a semi-crystalline polyester on a surface of the substrate wherein said semi-crystalline polyester has a glass transition temperature of from approximately 5° C. to 80° C., a melting temperature of from approximately 40° to 200° C., a crystallinity of from approximately 5 to 25 percent by weight, based on the total weight of the polyester, a weight average molecular weight of from approximately 10,000 to 150,000, a number average molecular weight of from approximately 5,000 to 75,000 and a surface energy of from approximately 44 dynes/cm to approximately 52 dynes/cm;

B. contacting said toner particles on said element with said semi-crystalline polyester coated receiver, said semi-crystalline polyester coated receiver being at a transfer temperature between approximately 45° C. and approximately 58° C. whereby virtually all of said toner particles are transferred from the surface of said element to said semi-crystalline polyester coating on said receiver; and C. separating said receiver from said element.

16. A method of transferring dry toner particles which comprise a toner binder and which have a particle size of 8 micrometers or less from an element to a receiver which comprises:

A. heating a receiver which comprises:

1. a substrate;
2. a coating of a semi-crystalline polyester on a surface of the substrate wherein said semi-crystalline polyester has a glass transition temperature of from approximately 5° C. to 80° C., a melting temperature of from approximately 40° C. to 200° C., a crystallinity of from approximately 5 to 25 percent by weight, based on the total weight of the polyester, a weight average molecular weight of from approximately 10,000 to 150,000, a number average molecular weight of from approximately 5,000 to 75,000 and a surface energy of from 44 dynes/cm to approximately 52 dynes/cm to a temperature of from approximately 70° C. to approximately 95° C.;

B. contacting said toner particles on said element with said semi-crystalline polyester coated receiver, said semi-crystalline polyester coated receiver being at a transfer temperature between approximately 45° C. and 58° C. whereby virtually all of said toner particles are transferred from the surface of said element to said semi-crystalline polyester coating on said receiver; and C. separating said receiver from said element.

17. A method of transferring dry toner particles from an element to a receiver which comprises:

A. heating a receiver which comprises:

1. a substrate;
2. a coating of a semi-crystalline polyester on a surface of the substrate wherein said semi-crystalline polyester has a surface energy of from 44 dynes/cm to approximately 52 dynes/cm and a crystallinity of from approximately 5 to 25 percent by weight based on the total weight of the polyester;

B. contacting said toner particles on said element with said semi-crystalline polyester coated receiver, said semi-crystalline polyester coated receiver being at a transfer temperature between approximately 45° C. and 58° C. whereby virtually all of said toner particles are transferred from the surface of said element to said semi-crystalline polyester coating on said receiver; and C. separating said receiver from said element.

18. The method of claim 16, wherein said semi-crystalline polyester is poly[hexamethylene-co-tetramethylene (80/20) terephthalate].

19. The method of claim 16, wherein said semi-crystalline polyester is poly[hexamethylene-co-tetramethylene (80/20) terephthalate-co-isophthalate (80/20)].

20. The method of claim 16, wherein said semi-crystalline polyester is poly[2,2'-oxydiethylene-co-ethylene (37/63) terephthalate].

* * * * *